United States Patent [19]

Tanaka

[11] 4,380,916

[45] Apr. 26, 1983

[54] ROLLING APPARATUS FOR SEQUENTIAL ROLLING

[75] Inventor: Teruaki Tanaka, Aichi, Japan

[73] Assignee: Daidotokushuko Kabushikikaisha, Japan

[21] Appl. No.: 294,875

[22] Filed: Aug. 21, 1981

[30] Foreign Application Priority Data

Aug. 28, 1980 [JP] Japan ..... 55-118969
Jul. 20, 1981 [JP] Japan ..... 56-113148

[51] Int. Cl.[3] ..... B21B 31/18

[52] U.S. Cl. ..... 72/7; 72/22; 72/221; 72/247; 364/472

[58] Field of Search ..... 72/7, 8, 21, 22, 221, 72/222, 229, 247; 364/472

[56] References Cited

U.S. PATENT DOCUMENTS 3,289,444 12/1966 Takuma ..... 72/7
4,059,794 11/1977 Furness et al. ..... 72/21

*Primary Examiner*—Francis S. Husar
*Assistant Examiner*—Jonathan L. Scherer
*Attorney, Agent, or Firm*—William A. Drucker

[57] ABSTRACT

A material is allowed to reciprocate along a conveyance line by conveyance systems. During reciprocation, the material is allowed to pass through different shape apertures provided by a rolling mechanism in the direction perpendicular to the conveyance line so that a desired rolling operation may be effected to the material.

4 Claims, 4 Drawing Figures

ROLLING APPARATUS FOR SEQUENTIAL ROLLING

BACKGROUND OF THE INVENTION

1. Field of the Invention

This invention relates to an apparatus for rolling a rod-shaped steel or other kind of metal by allowing the material to move in the horizontal direction and pass through a rolling mechanism.

2. Description of the Prior Art

One of the well-known methods of making rod-shaped material into a desired section (i.e., section steel or the like) or wire rod is as follows: A rod material is allowed to move along a conveyance line and pass between a pair of rolls which are rotatably supported in parallel with each other and each of which is provided with a plurality of shape grooves of different depths at the circumference thereof so that each pair of corresponding shape grooves of the rolls provides a "caliber" or shape aperture. The material is allowed to continue passing through the different calibers until a desired section or wire rod is obtained. In such rolling operation, however, when the material is moved in the direction perpendicular to the conveyance line thereof so as to enter into a different caliber after the rolling by one caliber is finished, it may happen that the material is damaged or bent. For removing such a defect, a new technique has been developed whereby the rolls rather than a material to be rolled is moved in such a direction together with the mechanism for holding the rolls. However, such a unit (comprising the rolls and holding mechanism) to be moved is extremely weighty, and if the unit is moved at a higher speed, it is very difficult to stop the unit from moving at the predetermined position with strict accuracy since they are subject to great inertia. On the other hand, if such a unit is moved so slowly that the unit may be accurately stopped from moving at the predetermined position, it takes a longer time to move the unit by a required amount.

SUMMARY OF THE INVENTION

An object of the invention is to provide a rolling apparatus which is adapted to make a rod-shaped material of a given thickness into a slenderer product by passing the material successively through different shape apertures formed by a plurality of shape grooves of a pair of rolls.

Another object of the invention is to provide a rolling apparatus which is adapted to make a rod-shaped material of a given thickness into a slenderer product by passing the material successively through different shape apertures formed by a plurality of shape grooves of a pair of rolls while moving the rolls in the direction perpendicular to a conveyance line of the material in the course of conveying or reciprocating the material along the conveyance line.

A further object of the invention is to provide a roll-apparatus wherein the rolling order of a material is decided in advance so that a pair of rolls are so moved as to locate particular shape apertures thereof on a conveyance line of the material in the predetermined order while reciprocating the material along the conveyance line.

A still further object of the invention is to provide a rolling apparatus including a shifting mechanism for moving a pair of rolls at a higher speed until a required shape aperture thereof comes to the predetermined position in immediate proximity to a conveyance line of a material, but moving the rolls at a lower speed after the required shape aperture has reached that position so that the rolls may be not only moved by a required amount for a shorter period of time, but also stopped from moving at the predetermined position with strict accuracy.

Other objects and advantages of this invention will become apparent during the following discussion of the accompanying drawings.

BRIEF DESCRIPTION OF THE DRAWINGS

FIG. 2 also illustrates the relationship among a truck, shift system, and control system employed for the rolling mechanism.

DESCRIPTION OF THE PREFERRED EMBODIMENTS

Figure 1:
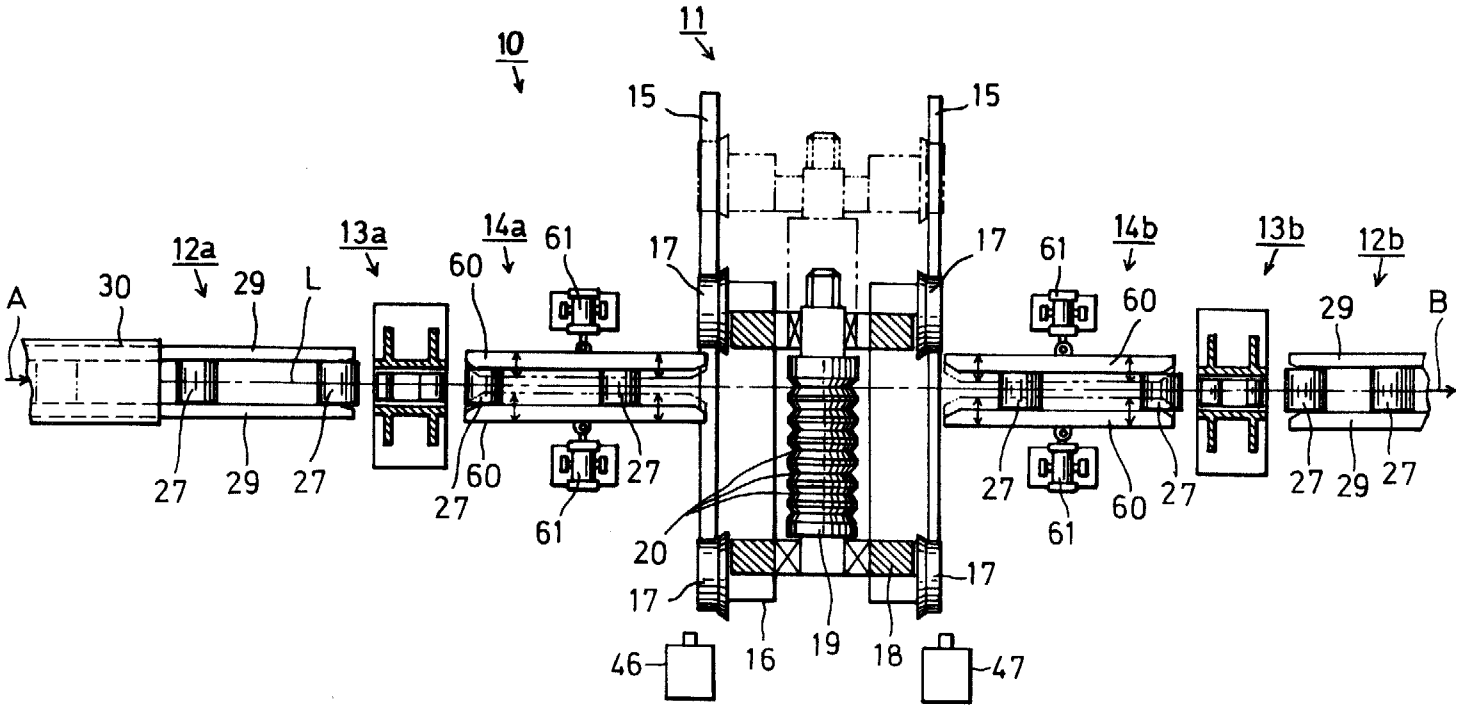
FIG. 1 is a schematic plan view of a rolling apparatus according to the invention.

Referring to FIG. 1, a rolling apparatus 10 according to the invention comprises a rolling mechanism 11, a pair of conveyance systems **12*a* and 12*b*, a pair of rotating devices 13*a* and 13*b*, and a pair of work-path correcting devices 14*a* and 14*b*. As is clearly shown in FIG. 1, the group of conveyance system 12*a*, rotating device 13*a* and work-path correcting device 14*a* is opposite to the other group of conveyance system 12*b*, rotating device 13*b* and work-path correcting device 14*b*, with the rolling mechanism 11 being disposed therebetween. As is also clearly shown in FIG. 1, the rolling mechanism 11, conveyance systems 12*a* and 12*b*, rotating devices 13*a* and 13*b*, and work-path correcting devices 14*a* and 14*b*** are all aligned along a substantially-horizontal conveyance line L for a material to be rolled.

The conveyance systems **12*a* and 12*b* each include a plurality of rollers 27 aligned along the conveyance line L, a pair of side plates 29 provided on both sides of the rollers 27 for preventing the material from dropping from on the rollers 27, and a cover 30 attached to the side plates 29 for preventing the material from being cooled (although only the cover 30 for the conveyance system 12*a* is shown in FIG. 1). The rollers 27 each are connected to a drive motor (not shown) adapted to rotate the rollers 27** in either direction.

As is well known in the art, the rotating devices **13*a* and 13*b*** each is adapted to rotate the material with the conveyance line L as the central point of rotation.

The work-path correcting devices **14*a* and 14*b* each include a pair of locating plates 60 connected to hydraulic cylinders 61, respectively. The locating plates 60 are moved over the rollers 27 by the cylinders 61 in the directions indicated by arrows (FIG. 1), i.e., with the conveyance line L therebetween so that the distance between the plates 60** may be varied for correction or adjustment of the path of work or material if the material happens to deviate from the conveyance line L, in other words, for the returning of the material onto the line L if such a case happens.

Figure 2:
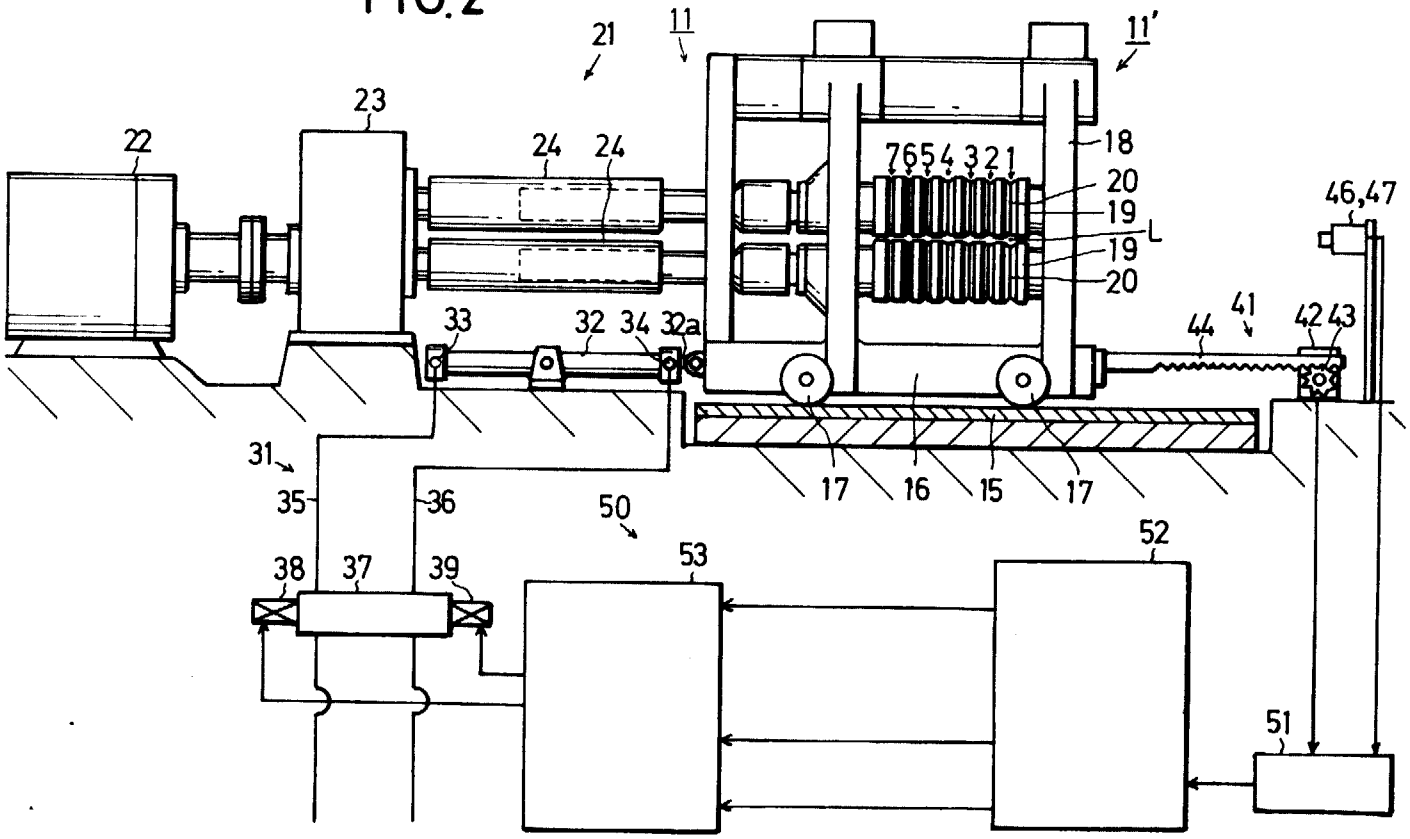
FIG. 2 is an elevational view of a rolling mechanism used for the rolling apparatus of FIG. 1, as viewed from the right side in FIG. 1.

Referring to FIG. 2, the rolling mechanism 11 comprises a rolling 11', drive system 21, shift system 31, control system 50, a truck-position detecting system 41, and a pair of means 46 and 47 for detecting the completion of rolling operation.

The rolling unit 11' includes a truck 16 having a plurality of wheels 17 to allow the truck 16 to move along rails 15. A frame 18 is attached to the truck 16, and includes a pair of upper and lower rolls 19 disposed in parallel with each other. The rolls 19 each have a plurality of grooves or shape grooves 20, and each pair of upper and lower shape grooves 20 provide a shape aperture (or so called "caliber") to allow a material to be rolled to pass therethrough. The whole of upper and lower rolls 19 therefore provide a plurality of shape apertures. The shape apertures are varied in size from one another so that the material may be made slenderer by passing the material between the rolls 19 a number of times (i.e., through the different shape apertures). In FIG. 2, the shape apertures are given the numbers 1 to 7 in order of size (from the rightmost aperture in FIG. 2).

The rolling unit 11' is connected to the drive system 21 for rotating the rolls 19. The drive system 21 includes a drive motor 22 adapted to rotate in either direction, a pinion stand 23 having a pair of output shafts which each is adapted to rotate in opposite direction by receiving the output from the drive motor 22, and a pair of expansion joints 24 connecting the output shafts of the pinion stand 23 to the rolls 19.

The rolling unit 11' is also connected to the shift system 31 for moving the rolling unit 11' along the rails 15. The shift system 31 includes an actuator 32 communicated with an electromagnetic ratio valve 37 by means of pressure-oil lines 35 and 36. The actuator 32 is connected onto a base of the rolling mechanism 11, and also has a pinion rod **32*a* connected to the rolling unit 11' at one end. The actuator 32 is also provided with a pair of ports 33 and 34. The pressure-oil line 35 is connected to the port 33 at one end, while the other pressure-oil line 36 is also connected to the other port 34 at one end. Located in the middle of the pressure-oil lines 35 and 36, the electromagnetic ratio valve 37 has a pair of solenoids 38 and 39. Further extending from the valve 37, the two lines 35 and 36 each are also connected at the other end to a well-known means in the art, such as a pressure-oil supply device or a drain (not shown). Incidentally, although a hydraulic cylinder is used as the actuator 32 in the embodiment herein, an air cylinder may be alternatively used as the actuator 32. Also, the drive system 31** may comprise an electric motor instead of the above-mentioned construction.

The rolling unit 11' is further connected to the truck-position detecting system 41. The detecting system 41 is mainly constructed of a potentiometer 42 having a pinion 43 and a rack 44 connected to the truck 16 at one end and engaged with the pinion 43 at the other end. Therefore, the pinion 43 is adapted to rotate as the rolling unit 11' or truck 16 is moved along the rails 15, and the potentiometer 42 provides signals indicating the position of the truck 16 at all times during rolling operation. A synchronous generator may be used instead of the potentiometer 42. Also, the whole detecting system 41 does not necessarily need to be of such mechanical construction as mentioned above, but may comprise such mechanism as utilizes a laser or the reflection of ultrasonic waves.

A pair of means 46 and 47 are adapted to detect the completion of one rolling operation of the material every time the material has passed between the rolls 19, by detecting the presence of the material on both sides of the rolling unit 11', respectively. Although photoelectric devices are used as detecting means 46 and 47 in the embodiment herein, the alternative device used as such means 46 and 47 may be limit switches disposed in immediate proximity to the conveyance line L so as to operate by touching the material, or magnetically-detecting devices where the material to be rolled is a magnetic one such as steel.

The function of the control system 50 is to control the rolling unit 11' or truck 16 moving or shifting along the rails 15. The control system 50 may be roughly divided into signal-generating sections 51 and 52 and a control section 53. The section 51 is adapted to generate signals indicating the moving amount of the truck 16, while the section 52 is adapted to generate signals indicating both moving direction and moving speed of the truck 16 in accordance with the signal generated by the section 51. The signal-generating section 51 has such a construction as shown in the block diagram of FIG. 3. The third section 53 controls the function of shift system 31 in accordance with the signal generated by the section 52.

Figure 3:
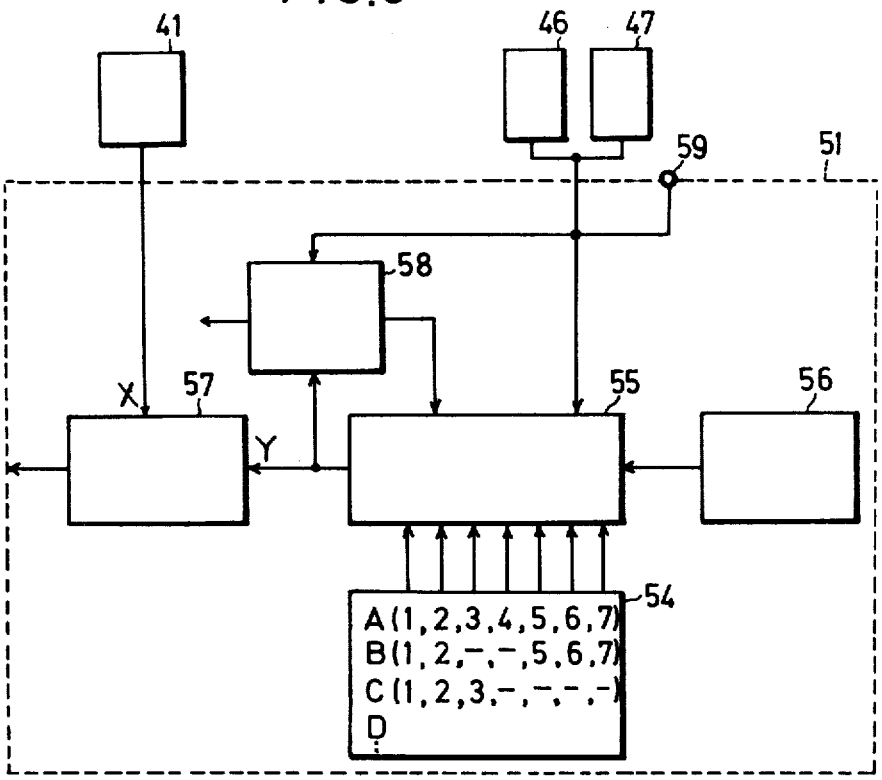
FIG. 3 is a block diagram of a shifting-amount signal generating section used for the rolling mechanism of FIG. 2.

Referring to FIG. 3, the whole signal-generating section 51 may be subdivided into or comprises a rolling-order setting unit 54, shift-position selecting unit 55, initial-position setting unit 56, computing unit 57, command unit 58, and signal-input unit 59.

The rolling-order setting unit 54 is adapted to store different programs of rolling order in memory in advance, and allows the operator manually to select a desired one of the programs stored therein. For example, the following programs may be set by using the setting unit 54:

Program A: A material is to be rolled by passing it through all shape apertures of the rolls 19 in order of size of the apertures, i.e., from the 1st aperture to the smallest or 7th aperture.

Program B: A material is to be rolled by passing it through the 1st, 2nd, 5th, 6th and 7th apertures in the order mentioned. The material is not to be passed through the 3rd and 4th apertures.

Program C: A material is to be rolled by passing it through the 1st, 2nd and 3rd apertures in the order mentioned. The material is not to be passed through the 4th to 7th apertures.

The rolling-order setting unit 54 is also adapted to provide the shift-position selecting unit 55 with signals indicating the positions of the shape apertures so as to indicate the particular aperture to be located on the conveyance line L to the selecting unit 55. For example, if the position of the 1st aperture is taken to be 0 mm as the reference position, the positions of the 2nd to 7th apertures may be −150 mm, −300 mm, −450 mm, −600 mm, −750 mm, and −900 mm, respectively.

The shift-position selecting unit 55 is adapted to select and output the signals of position of shape apertures received from the setting unit 54 in accordance with the order set by the particular program stored in the unit 54 every time one rolling operation of the material has been detected by the detecting means 46 and 47.

The initial-position setting unit 56 may be manually operated to provide the shift-position selecting unit 55 with the command which causes the unit 55 to select the first aperture in any program stored in the unit 54. Incidentally, it is to be noted that the first aperture in any program is not necessarily the aperture indicated by numeral (1) in FIG. 2, but may be any other aperture according to the particular programming order. In all program examples A to C previously cited, however, the ordinal numbers attached to the apertures correspond to the numerals (1) to (7) given to the apertures in FIG. 2, and it is true of the description hereinafter unless otherwise mentioned.

The computing unit 57 is adapted to receive the signal (X) from position-detecting system 41 and the signal (Y) from shift-position selecting unit 55 and takes the value of signal (Y) from that of the other signal (X) to find the difference between the two (X-Y). The computing unit 57 then outputs the differential value to the second signal-generating section 52.

The command unit 58 is adapted to provide the shift-position selecting unit 55 with the command which causes the unit 55 to re-select the first aperture of the particular program (not neccessarily the aperture (1) in FIG. 2) stored in the setting unit 54 when the following two conditions have been produced: (1) All apertures set by that particular program have been selected by the unit 55 and (2) the completion of the rolling operation employing those apertures has been detected by the detecting means 46 and 47. At the same time when giving the above-mentioned signal to the selecting unit 55, the command unit 58 also provides the conveyance system **12*b* with the command which causes the system 12*b*** to discharge the rolled material from the whole rolling apparatus.

The signal-input unit 59 is adapted to allow the operator manually to generate and output similar signals to those output by the detecting means 46 and 47 when such signals are to be used as not coming from the detecting means 46 and 47.

The second signal-generating section 52 for producing the signal indicating both moving direction and moving speed of the truck 16 or rolling unit 11' is adapted to output such signals as shown in the following Table in accordance with the plus or minus and magnitude of the absolute value of the differential signals received from the computing unit 57 of the first signal-generating section 51:

TABLE

| Plus/minus | Absolute value | Output signals |
|---|---|---|
| plus | larger than the 1st marginal value | plus command signal for higher-speed shifting |
| minus | larger than the 1st marginal value | minus command signal for higher-speed shifting |
| plus | smaller than the 1st marginal value | plus command signal for lower-speed shifting |
| minus | smaller than the 1st marginal value | minus command signal for lower-speed shifting |
| plus or minus | smaller than the 2nd marginal value | command signal for stop |

The first and second marginal values in the above Table are to be set in accordance with both inertial mass of the rolling unit 11' and the performance of the shift system 31 so that the rolling unit 11' or truck 16 may be smoothly changed from a higer-speed shifting to a lower-speed shifting or from a lower-speed shifting to the stopping at the predetermined position. Also, the speeds of faster and slower shifting of the truck 16 are to be set in such a manner. For example, the first and second marginal values may be set at 200 mm and 5 mm, respectively, while the speeds of faster and slower shifting of the truck 16 may be set at 280 mm/sec. and 15 mm/sec., respectively.

The control section 53 of the control system 50 is adapted to control the operation of the solenoids 38 and 39 of the electromagnetic ratio valve 37 in accordance with the above-mentioned command signals received from the second signal-generating section 52.

Description is then given to the rolling operation by the apparatus herein, taking three examples wherein the previously-mentioned programs A, B, and C, respectively, have been selected from among the different programs stored in the setting unit 54 of the signal-generating section 51:

(1) Program A has been selected: The initial-position setting unit 56 is so operated in advance so as to cause the shift-position selecting unit 55 to select the 1st shape aperture (1) of the rolls 19. By this operation, the 1st aperture (1) is located on the conveyance line L. In this condition, a material to be rolled is allowed to come from a heating furnace (not shown) and move on the rollers 27 (being rotated by the drive motors) in the conveyance system **12*a* along the conveyance line L in the direction indicated by A (in FIG. 1). The material is then allowed to pass through the 1st aperture (1) of or between the rolls 19 so that the material is rolled by the aperture (1). The rolled portion of the material is allowed to come out of the rolls 19 and move on the rollers 27 (being rotated by the drive motors) in the conveyance system 12*b* along the conveyance line L, and when the whole material has projected from the rolls 19 or rolling unit 11' onto the conveyance system 12*b*, a well-known detecting device in the art (not shown) detects it with the result that the material is stopped from moving on the rollers 27 in the conveyance system 12*b***.

The whole material having been projected from the rolling unit 11' is also detected by the detecting means 46 and 47 giving no signals indicating the presence of material any longer. Having detected the completion of one rolling operation in this way, the detecting means 46 and 47 send completion signals to the shift-position selecting unit 55. The unit 55 then selects the 2nd aperture (2) and send a signal indicating the position thereof. On the other hand, the truck-position detecting system 41 sends the signal of current position of the truck 16 or rolling unit 11' to the computing unit 57. And when the rolling operation by the 1st aperture (1) has been completed, the position of truck or rolling unit is 0 mm. The signal of current position of truck 16 given to the computing unit 57 at this stage is therefore a zero signal. The computing unit 57 then takes the value (−150 mm) of signal received from the selecting unit 55 from the value (0 mm) of signal received from the truck-position detecting system 41 to find the difference of 150 mm between the two $(0-(-150)=150)$.

The computing unit 57 then sends the differential signal to the second signal-generating section 52, and the second section 52 then judges the signal according to the previous Table, so that the section 12 sends a plus command signal for lower-speed shifting to the control section 53. Receiving such a signal, the control section 53 then controls the operation of the solenoids 38 and 39 of the ratio valve 37 so that a stream of oil under lower pressure is allowed to enter into the actuator 32 from the left port 33 thereof (FIG. 2). By this process, the piston rod 32*a* of actuator 32 is allowed to extend slowly, thereby causing the rolling unit 11' or truck 16 to move slowly along the rails 15 to the right side (in FIG. 2).

When the truck 16 or rolling unit 11' is moved in this way, the truck-position detecting system 41 detects the ever-changing position of truck 16 continuously or incessantly, and sends the signals of truck position obtained by such a detection to the computing unit 57. Continuously receiving the different position signals from the system 41, the computing unit 57 continuously takes the value (one of position of the 2nd aperture) of signal already received from the selecting unit 55 from the value (one of ever-changing position of the truck) received from the detecting system 41 to find the difference between the two, and continuously sends the differential signals (i.e., those of differential values) obtained by such a continuous calculation to the control section 53. And when the value of signal from the computing unit 57 has become smaller than the second marginal value (5 mm), the second section 52 sends a stop-command signal to the control section 53, and the section 53 then stops the operation of actuator 32 by controlling the ratio valve 37, thereby causing the truck 16 to stop with the 2nd aperture (2) being accurately located on the conveyance line L.

Incidentally, the second marginal value is to be set in accordance with the thickness of a material to be rolled (e.g., the material in this example has a squared cross section and a thickness of 145 mm) so that the actual position of the material relative to the conveyance line L when located on the line L according to such a marginal value may be substantially the same as the strictly-accurate position on the line L.

When the 2nd aperture (2) has been located on the conveyance line L, the rollers 27 in the conveyance system 12*b* are rotated in the opposite direction to the previous direction so that the material is allowed to pass between the rolls 19 again, but through the different aperture (2) this time. Having been rolled by the aperture (2), the material is allowed to come onto the rollers 27 in the conveyance system 12*a*. And when the whole material has projected onto the system 12*a*, the detecting device (not shown) detects it will the result that the rollers 27 are stopped from rotating.

The completion of the rolling operation by the 2nd aperture is also detected by the detecting means 46 and 47. The detecting means 46 and 47 then send rolling-completion signals to the selecting unit 55, and the unit 55 then selects the 3rd aperture (3) and sends a signal indicating the position (−300 mm) of the aperture (3) to the computing unit 57. Thereafter, the same operation as the previous one for locating the aperture (2) is made so that the aperture (3) is located on the conveyance line L with strict accuracy.

When the aperture (3) has been located on the line L, the conveyance system 12*a* is operated so that the material is passed between the rolls 19 again, but through the different aperture (3) this time for rolling operation thereby. Thereafter, the same operations as those hereinbefore are successively repeated. That is, the remaining apertures (4) to (7) are successively located on the conveyance line L while the material is reciprocated along the line L so that the material is rolled by all apertures.

Having been rolled by the 7th or last aperture (7), the whole material is allowed to come from the rolls 19 onto the the conveyance system 12*b*, and the detecting means 46 and 47 send rolling-completion signals to the command unit 58. When receiving those signals from the detecting means 46 and 47, the command unit 58 has already been informed that the 7th or last aperture (7) of the program A was selected by the selecting unit 55. Receiving the completion signals from the detecting means 46 and 47, therefore, the command unit 58 sends the selecting unit 55 a signal which causes the unit 55 to select the 1st aperture (1) again, while sending the conveyance system 12*b* a signal which cause the system 12*b* to discharge the rolled material from the whole rolling apparatus in the direction B (in FIG. 1).

After selecting the aperture (1), the selecting unit 55 sends the computing unit 57 a signal indicating the position (0 mm) of the aperture (1). Also, the computing unit 57 continuously receives a signal indicating the current position of the truck 16 or rolling unit 11' from the detecting system 41. At this stage, such a signal received by the unit 57 is one of −900 mm. The computing unit 57 then takes the value (0 mm) of signal from the selecting unit 55 from the value (−900 mm) of signal from the detecting system 41 to find the difference of −900 mm between the two (−900−0=−900).

The computing unit 57 then sends the differential signal to the second signal-generating section 52. The second section 52 then judges the signal in accordance with the previous Table, so that the section 52 sends a minus command signal for higher-speed shifting to the control section 53. Receiving such a signal therefrom, the control section 53 then so controls the operation of ratio valve 37 that a stream of oil under higher pressure is allowed to enter into the actuator 32 from the right port 34 thereof (in FIG. 2). Then, the piston rod 32*a* of actuator 32 is allowed to retract at a higher speed, thereby causing the truck 16 to move or shift to the left side (in FIG. 2) at a higher speed.

When the truck 16 is moved in this way, the detecting system 41 continuously detects the ever-changing position of the truck and the computing unit 57 also continuously calculates the difference between the value of current position of the truck and that of position of the aperture (1) to be located on the conveyance line L. And when the differential signal from the unit 57 has become smaller than the first marginal value, the second signal-generating section 52 sends the control section 53 a minus command signal for a lower-speed shifting. Receiving such a signal from the second section 52, the third section 53 so controls the operation of ratio valve 37 that the stream of oil is entered under lower pressure into the actuator 32, thereby causing the truck 16 to change the shifting speed thereof from the higher one to the lower one.

In the course of such a lower-speed shifting, when the value of signal from the computing unit 57 to the second section 52 has become smaller than the second marginal value, the second section 52 outputs a command signal for stop. The truck 16 is then stopped from shifting, with the aperture being accurately located on the conveyance line L.

The rolling operation of one material is thus completed. Thereafter, new materials are successively allowed to come onto the apparatus herein from the heating furnace and to be rolled thereby in the same manner as above mentioned.

If any material is bent during the rolling operation, such a defective material is to be removed from the apparatus, followed by manually operating the initial-position setting unit 56 so that the aperture (1) is again selected for the same rolling operation to be effected to the next material.

Also, if the rolling operation has been started with the program A being selected, but the necessity of eliminating the use of two or more apertures (e.g., apertures (2) and (3)) for rolling operating arises during the operation, the signal-input unit 59 is to be manually operated after passing the material through the aperture (e.g., aperture (1)) immediately before those apertures not to be used so that the unit 59 outputs such a signal as causes the selecting unit 55 to select the next aperture to be used (e.g., aperture (4)).

(2) Program B has been selected: In this case, the rolling operation is started in the same manner as in the previous case (1). When the detecting means 46 and 47 have detected the completion of rolling operation by the aperture (2) and sent a signal to indicate the completion to the selecting unit 55, the unit 55 then selects the aperture (5) and sends a signal to indicate the position (−600 mm) of the aperture (5) to the computing unit 57. The unit 57 then calculates the difference between the value (−150 mm) of signal from the detecting system 41 and the value (−600 mm) of signal from the unit 55, and sends a signal of differential value 450 mm (−150−(−600)=450) to the second section 52. The section 52 then outputs a plus command signal for higher-speed shifting to the control section 53. Receiving such a signal from the section 52, the section 53 then so controls the operation of ratio valve 37 that a stream of oil under higher pressure is allowed to enter into the actuator 32 from the left port 33 thereof (in FIG. 2), thereby causing the piston rod 32*a* of actuator 32 to extend at a higher speed with the result that the truck 16 or rolling unit 11' is moved to the right side (in FIG. 2) at a higher speed. And when the value of signal from the computing unit 57 has become smaller than the first marginal value, the second section 52 outputs a plus command signal for lower-speed shifting to cause the truck 16 to change shifting speed to the lower one. When the value of the signal from the unit 57 has become smaller than the second marginal value, the second section 52 outputs a command signal for stop causing the truck 16 to stop moving, with the aperture (5) being accurately located on the conveyance line L. Thereafter, the rolling operation by the apertures (5), (6) and (7) is made in the same manner as in the previous case (1), and when the whole rolling operation has been completed, the material is allowed to come from the whole rolling apparatus and the truck 16 or rolling unit 11' is returned to the initial position.

(3) Program C has been selected: In this case, the rolling operation by the apertures (1), (2) and (3) is made in the same manner as in the previous case (1). When the rolling operation by the aperture (3) is completed, the command unit receives a signal of rolling completion from the detecting means 46 and 47, while having already received from the selecting unit 55 a signal which indicates that all apertures in the program were selected. The command unit 58 then has the previously-mentioned two conditions, and therefore commands the unit 55 to select the aperture (1) again, while commanding the conveyance system 12*b* to discharge the material from the rolling apparatus. Then, the truck 16 or rolling unit 11' is returned to the initial position and the rolled material is allowed to move in the direction indicated by B (FIG. 1).

Figure 4:
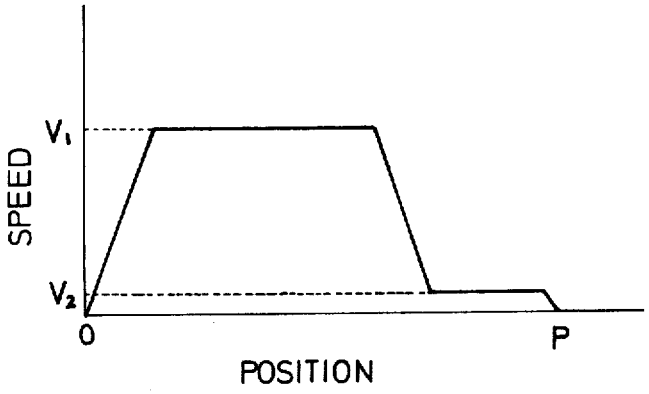
FIG. 4 is a graph showing the correlation between the position of the truck for rolling mechanism of FIG. 2 and the speed of shifting or moving of the rolling mechanism.

FIG. 4 illustrates the correlation between the ever-changing position of the truck 16 starting to move from the point (O) to reach the required position (P) and the speed of moving or shifting of the truck 16 at each position.

When starting to move from the point (O), the truck 16 is accelerated because of a greater inertia of the whole rolling unit 11'. After reaching a higher speed $V_1$, the truck moves at such a higher speed for a while, and when coming nearer to the required position (P), the truck starts to move at a lower speed $V_2$. Because of inertia, the truck is then decelerated, and when the truck comes to immediate proximity with the position (P), in other words, comes into such a distance from the position (P) as may be disregarded for practical purposes, that is, the truck position comes to the second marginal value, operation is so made as to stop the truck from moving. When such operation has been made, however, the truck continues to move by a slight amount because of inertia thereof, so that the truck may be stopped almost exactly on the required position (P).

As previously mentioned, the second signal-generating section 52 is adapted to output command signals for higher-speed shifting and lower-speed shifting and a command signal for stop by comparing signals from the computing unit 57 with the first and second marginal values, respectively. Alternatively, however, it is possible that the second section 52 uses the first marginal value for providing a higher-speed shifting command and a lower-speed shifting command, but instead of using the second marginal value, sends the control section 53 the signal from the computing unit 57 which is zero signal or a signal of such a small value as may be practically disregarded, so as to stop the truck from moving.

As many apparently widely different embodiments of this invention may be made without departing from the spirit and scope thereof, it is to be understood that the invention is not limited to the specific embodiments thereof except as defined in the appended claims.

What is claimed is:

1. A rolling apparatus comprising first and second conveyance systems spaced apart from each other along a conveyance line for reciprocating a material to be rolled along said conveyance line and a rolling mechanism so disposed that said conveyance line extends therethrough for rolling the material during reciprocation thereof, said rolling mechanism including:

a. a rolling unit having a frame adapted to move in the direction perpendicular to said conveyance line, a pair of rotatable rolls each provided with a plurality of shape grooves at the circumference thereof and disposed so that said conveyance line continuously extends therebetween, a plurality of shape apertures provided between said rolls by said shape grooves for rolling the material;

b. a drive system connected to said rolling unit for rotating said rolls;

c. a shift system connected to said rolling unit for moving said rolling unit in the direction perpendicular to said conveyance line so as to selectively locate said shape apertures on said conveyance line;

d. a system connected to rolling unit for detecting the position of said rolling unit relative to said conveyance line and providing a signal to indicate said position; and e. a system connected to said shift system for controlling said shift system and including (1) a unit for setting the order of locating said shape apertures on said conveyance line, (2) a unit for selecting said shape apertures set in said setting unit in said order and providing a signal to indicate the particular shape apertures to be located on said conveyance line, (3) a unit for computing the difference between the value of signal from said detecting system and that of signal from said selecting unit and providing a signal to indicate said difference, (4) a unit for generating signals to indicate the speed of moving of said rolling unit by receiving the differential signal from said computing unit so that said generating unit provides a signal to move said rolling unit at a higher speed when the value of said differential signal is larger than a first marginal value, a signal to move said rolling unit at a lower speed when said value is smaller than said first marginal value but larger than a second marginal value, and a signal to stop said rolling unit from moving when said value is smaller than said second marginal value, and (5) a section for controlling said shift system in accordance with the signals from said generating unit.

2. A rolling apparatus in accordance with claim 1 further including a means for detecting the completion of rolling operation by the particular one of said shape apertures and sending said selecting unit a signal to indicate the completion of rolling operation so as to cause said selecting unit to select the next shape aperture to be located on said conveyance line.

3. A rolling apparatus in accordance with claim 2 further including a command unit adapted to detect a condition that the last one of said shape apertures set in said setting unit has been selected by said selecting unit and another condition that the completion of rolling operation by said last aperture has been detected by said detecting means and command said selecting unit to select the first one of said shape apertures set in said setting unit when having detected said two conditions.

4. A rolling apparatus in accordance with claim 2 or 3 further including an initial-position setting unit whereby said selecting unit is manually commanded to select the first one of said shape apertures set in said setting unit.

* * * * *